United States Patent [19]

Shilov et al.

[11] 4,378,687

[45] Apr. 5, 1983

[54] METHOD FOR ROLLING H-SECTIONS IN CONTINUOUS MILL

[76] Inventors: Vladislav A. Shilov, ulitsa S. Kovalevskoi, 1, kv. 77; Vitaly K. Smirnov, ulitsa Malysheva, 130-b, kv. 31; Viktor S. Pechersky, ulitsa 40 let Oktyabrya, 36, kv. 7, all of Sverdlovsk; Alexandr A. Kugushin, Kemerovskoi oblasti, prospekt Metallurgov, 25, kv. 128, Novokuznetsk; Vladimir N. Bespalov, Kemerovskoi oblasti, ulitsa Kurako, 16, kv. 85, Novokuznesk; Jury O. Labetsky, Kemerovskoi oblasti, ulitsa Kirova, 56, kv. 61, Novokuznesk; Boris M. Melnikov, Kemerovskoi oblasti, ulitsa Suvorova, 2, kv. 79, Novokuznetsk, all of U.S.S.R.

[21] Appl. No.: 227,368

[22] Filed: Jan. 22, 1981

[51] Int. Cl.[3] ..... B21B 1/08

[52] U.S. Cl. ..... 72/366; 72/199

[58] Field of Search ..... 72/365, 366, 199, 203, 72/206, 235, 221, 225, 240

[56] References Cited

U.S. PATENT DOCUMENTS 1,603,518 10/1926 Coates ..... 72/366

4,268,948 5/1981 Strandell et al. ..... 72/221

FOREIGN PATENT DOCUMENTS 47-47780 12/1972 Japan ..... 72/206

947013 1/1964 United Kingdom .

OTHER PUBLICATIONS

Roll Design and Mill Layout by Ross E. Beynon—Moscow, 1960.

Production of H-Beams—N. F. Grytsuk, S. P. Antonov—Moscow 1973.

Iron and Steel Engineer, 1974, v. 51, No. 1, W. J. Ammerling et al. Kinzoku, 1975 v. 45, No. 1, N. Takaaki.

Roll Pass Design by B. P. Bakhtinov and M. M. Shternov-Moscow 1953.

Roll Design Relationship in Rolling of Shaped Beams at a High-Duty Mills-CSSR 1976.

*Primary Examiner*—Francis S. Husar

*Assistant Examiner*—Jonathan L. Scherer

*Attorney, Agent, or Firm*—Myron Greenspan; Bruce E. Lilling; Burton L. Lilling

[57] ABSTRACT

A method for rolling H-sections in a continuous mill comprises bevelling of the leading edge of a billet on the faces which are horizontal during rolling and subsequent rolling thereof in slitting and beam passes. The end of the billet is bevelled at an angle of 20°-30° relative to the horizontal axis thereof.

3 Claims, 4 Drawing Figures

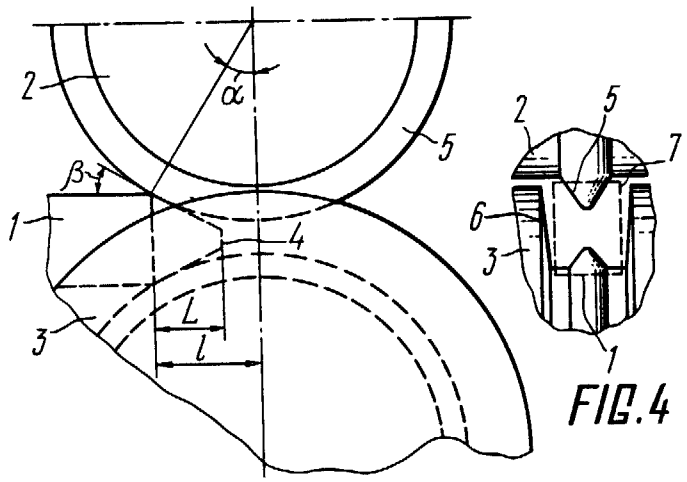
FIG. 2
FIG. 4
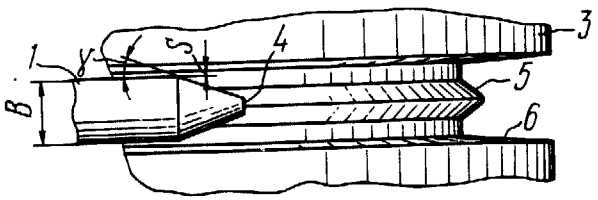
FIG. 3
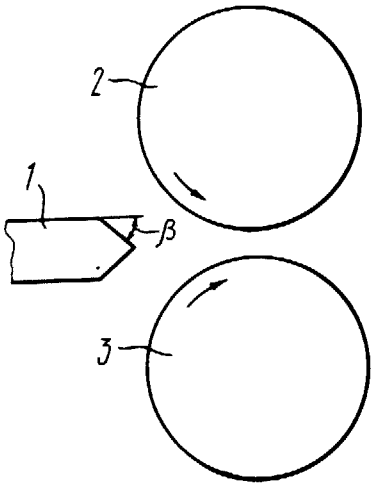
FIG. 1

METHOD FOR ROLLING H-SECTIONS IN CONTINUOUS MILL

FIELD OF THE INVENTION

The invention relates to rolling of sections and, more particularly, to methods of rolling H-sections in continuous mills.

The present invention is readily adapted to application on a fully continuous mill equipped with horizontal, vertical and universal stands where a maximum productivity, a greater dimensional stability and a better quality of products can be achieved.

Rolling in a continuous mill produces the highest rolling speed, and, therefore, the highest output capacity, the least drop in temperature of the strip, and both high accuracy and stability of the dimensions of H-sections, particularly of the light-weight and the thin-webbed ones. In addition, continuous rolling improves the mechanical properties of H-sections.

H-sections can be manufactured by various methods.

DESCRIPTION OF THE PRIOR ART

There is known a method for rolling H-sections in single-line mills (see Ross E. Beynon "Roll Design and Mill Layout", Metallurgizdat Publishers, 1960, pp. 23–24).

According to this method, rolling is conducted in successively arranged rolls with slitting and beam passes having a neck, closed flanges with tapers of external faces of 2–4% and open flanges with external face tapers of 6–12%. The open and the closed flanges alternate with change in the direction of the tapers of their external faces after each pass.

A rectangular billet is rolled successively, first in a slitting pass and then in beam passes. In each pass, the billet is worked only once, being turned into a strip of H-shaped cross section.

Delivery guides are provided back of the rolls to ensure correct exit and removal of the strip from the rolls.

After each passing, the strip enters the rolls by a different end. As the metal of the neck constantly slips backward relative to the rolls, the above alternations give rise to local neck elongations at both ends of the strip. These elongations facilitate the entry of the strips into the groove, as they are engaged by the pass neck and thus draw the strip into the rolls although the width of the strip on straightened out flanges exceeds that of the pass on closed flanges. The local elongation of the neck of the strip at the ends thereof helps in reliably pulling the strip out of the rolls by the delivery guides, as this elongated part is discharged from the pass onto the delivery guides in advance of the strip flanges and aids in pulling out the strip clamped in the deep closed flanges of the pass.

However, rolling in single-line mills is low in productivity and involves a substantial drop in strip temperature during rolling, thus impairing both the dimensional accuracy and stability of H-sections.

Another known method and pass design for rolling H-sections on universal beam mills equipped with reversible stands are those described by Gritsuk N. F., Antonov S. N. in "Proizvodstvo shirokolochnykh dvutavrov" /Manufacture of Wide-Flanged H-sections/, "Metallurgiya" Publishers, 1973, p. 25.

According to this method, a billet is first rolled in open beam passes of the breakdown reversible stand in 7 to 13 passings, then in universal beam passes of roughing, leader and finishing reversible stands.

In reversible stand rolling, the strip enters the rolls by alternate ends, thus producing at both ends of the strip local elongations of the strip neck, which facilitate the entry and the exit of the strip respectively into and out of a pass.

However, the use of the reversible stands keeps the productivity low, and leads to a substantial drop in strip temperature, particularly in the rolling of smaller H-sections. Therefore, this method is employed mainly for manufacturing large H-sections.

Widely known is a method for rolling H-sections in semi-continuous mills which consists of a reversible stand and a continuous group of horizontal and universal stands (Iron and Steel Engineer, 1974, v. 51, No. 1, W. J. Ammerling et al, "Continuous Medium-Section Mill for Beams and Others Sections", pp. 65–71, particularly p. 70; "Kinzoku", 1975, v. 45, No. 1, N. Takaaki, "Trends in the Manufacture of Complex Steel Sections and Rods", pp. 72–78, particularly p. 75).

According to this method, a rectangular billet is given initially 3–5 passings in the reversible stand of the mill, the strip entering the rolls by alternate ends, owing to which the necks are locally elongated at their ends. The strip is rolled next in a continuous group of stands, where it enters the rolls always by the same end. A local elongation of the neck at this end ensures a smooth entry of the strip into the closed passes of the horizontal stands and a reliable exit thereof out of the closed pass flanges, the same as in the single-line mills which have been described above.

In rolling according to this method, the provision of a continuous group of stands enhances mill productivity and both the dimensional accuracy and stability of sections being produced.

However, rolling in the reversible stand holds little promise as regards increased mill productivity, causes loss of temperature by the strip and results in an inefficient utilization of the continuous group of the mill.

Means to raise mill productivity and to enhance the dimensional accuracy and stability of H-sections, particularly of the thin-webbed ones, is to conduct rolling in continuous mills.

Rolling in a continuous mill provides a maximum rolling speed, and, therefore, a maximum productivity, minimizes the strip temperature drop, enhances both the dimensional accuracy and stability of H-sections, particularly of the light-weight and the thin-webbed ones. In addition, continuous rolling improves the mechanical properties of H-sections.

In metallurgy, there is known a method for rolling H-sections in a fully continuous mill which consists of horizontal stands only (see Bakhtinov B. P., Shternov M. M., "Kalibrovka prokatnykh valkov" /Roll Pass Design/, Metallurgizdat Publishers, 1953, pp. 586–587) or of horizontal and combined (horizontal and vertical) stands in the roughing group and of universal and combined stands in the finishing group ("Hutnik", CSSR, 1976, v. 26, No. 5, Polanski R., Roll Pass Design Relationships in Rolling of Sections in High-Productivity Mills, pp. 174–181, particularly p. 176).

According to this method, a billet is rolled successively in a slitting pass, roughing closed beam passes of horizontal stands and in universal beam passes of finishing stands. The strip passes through each stand once, and enters the rolls always by the same end, rolling being effected simultaneously in all or several stands of the mill. This raises productivity, minimizes strip temperature drop and improves both the dimensional accuracy and stability of rolled sections.

However, the introduction of this method for rolling H-sections involves considerable problems related to the entry of the strip in the passes always by the same end. Continuous mill operation practice and special investigations have indicated that no local elongation of the strip neck occurs despite the preferable reduction of the strip in the neck. Quite the reverse, the metal of the strip end, by which it always enters the rolls, shrinks lengthwise in the area of the neck relative to the flanges and separates into layers, an explanation to this being the high-rate metal flow conditions in the deformation zone of the beam pass. The peripheral speed of the rolls at the flange tip is substantially lower than that on the neck, as the diameter of the rolls on the flange tip is always smaller than that on the neck. As the speed of exit of the strip from the rolls corresponds to the mean effective diameter of the rolls, the flange speed of the strip is greater than the roll speed, whereas the neck strip speed is lower than the peripheral speed of the roll. Therefore, the neck of the strip features a zone of backward slip of metal relative to the rolls (backward flow of metal relative to the rolls) throughout the deformation zone. As a result, the end of the strip that enters the rolls suffers a shrinkage of the neck relative to the flanges and split cracks, whereas the trailing end has a local elongation of the neck.

The lack of local elongation of the neck at the strip end by which it enters the rolls substantially hampers the entry of the strip into the closed passes and the removal thereof out of the rolls by the delivery guides, as the strip enters the pass and exits from the pass not by its neck (as in the case of a local neck elongation at the strip end), but by the flanges. As the width of the strip on the open flanges is greater than that of the following pass on the closed flanges, the entry of the strip into the pass involves impacts against the rolls, and on exit of the strip from the pass, impacts of the strip against the delivery guides because the metal is pinched in the closed flanges of the pass, thereby reducing the durability and causing damage to the delivery rolls and a subsequent wrapping of the strip around the roll. These problems have prevented up to now the introduction of the rolling of H-sections in continuous mills with horizontal and universal stands.

Also known is a method for rolling metals, comprising a double-sided bevelling of the end of a billet with subsequent rolling thereof in a rolling mill (see USSR Inventor's Certificate granted on the Application No. 2,520,029/02, dated 17.081977, B 21b I/06 "Sposob prokatki metallov" /Metal Rolling Method/).

According to this method, one of the ends of a billet is given, prior to rolling, a double bevel, with the top and the bottom faces forming an angle of 50°-75° with the horizontal axis (i.e. the vertex angle of the bevelled faces equalling 100°-150° ).

The billet is then worked in the rolling mill by engaging it into the rolls by the bevelled end. This facilitates the entry of the strip into the rolls, minimizes impacts of the strip against the rolls and the delivery guides, and enhances the durability of the rolling equipment.

However, in continuous H-section rolling, the above bevelled shape of the strip end fails to lessen the impacts of the strip against the rolls and the delivery guides and to prevent damage to the delivery guides and the wrapping of the strip around the rolls. This is caused because the bevelled billet end tends to level off relative to the vertical because of: first, build-up of metal on the top and the bottom bevelled faces as the metal enters the slitting pass; and second, lengthwise shrinkage of the leading end of the strip during rolling in the beam passes due to the above backward slip of metal in the neck deformation zone.

The blunting of the strip end gives rise to all the above-mentioned problems in continuous H-section rolling: separation into layers of the strip end which enters the rolls; impacts of the strip against the rolls as it enters the passes and against the delivery guides as it is discharged from the passes; shorter service life and damage to the delivery guides; and wrapping of the strip around the rolls.

SUMMARY OF THE INVENTION

It is therefore the main object of the invention to provide a method for rolling H-sections in a continuous mill, which would facilitate the entry and the exit of a strip respectively into and out of passes.

Another important object of the invention is to provide a method for rolling H-sections in a continuous mill, which would enhance the durability of the delivery guides and prevent damage to them.

Yet another object of the invention is to provide a method for rolling H-sections in a continuous mill, which would prevent the wrapping of the strip around the rolls.

The above and other objects are attained by a method for rolling H-sections in a continuous mill, comprising bevelling of the end of a billet on the faces which are to be horizontal during rolling and subsequent rolling in slitting and beam passes; wherein the end of the strip is bevelled at an angle of 20°-30° relative to the horizontal axis of the billet.

With the leading end of the strip having top and bottom faces bevelled at an angle of 20°-30° to the horizontal, the strip engages a beam pass on the neck thereof, as in single-line mills with the strip provided with a local neck elongation at the end. Once gripped by the rolls, the bevelled part of the strip smoothly pulls into the pass the whole strip, although the width thereof on open flanges is greater than that of the pass on closed flanges. The smooth entry of the strip flanges into the pass is also facilitated by a gradual increase of the height thereof on the bevelled end of the strip. This eliminates impacts of the flanges against the external faces of the pass and contributes substantially to an easy entry of the strip into the beam passes.

The bevelled end of the strip comes out of the pass onto a delivery guide aligned with the pass neck in advance of the flanges and, resting on the guide, aids in pulling the strip out of the closed pass flanges. This facilitates the delivery of the strip from the pass, avoids impacts of the flanges against the delivery guides and enhances the durability thereof, prevents damage to them and, therefore, prevents the wrapping of the strip around the rolls.

It has been found that the above effect is achieved at angles of bevel less than 30°. With angles of bevel greater than 30°, the bevelled end tends to level off relative to the vertical because of the build-up of metal in the slitting pass and the shrinkage of the forward end of the strip along the neck as it is rolled in beam passes. These phenomena can be compensated for by providing angles of bevel smaller than 30°.

However, with angles of bevel smaller than 20°, the bevelled forward end is excessively long. As the bevelled end of the strip is cut off after rolling, this results in a greater waste of metal and so proves that angles of bevel below 20° are inefficient.

It is advisable, according to the invention, to have the forward end of the strip additionally bevelled on the faces that are vertical during rolling at an angle smaller or equal to the angle of nip along the swell of the slitting pass. The faces that are horizontal and those that are vertical during rolling are bevelled over a length equal to 0.6–0.8 time the length of the deformation zone.

With the forward end of the strip bevelled on the faces that are vertical during rolling produces an artificial local elongation of the neck at the end of the strip, similar in shape to a local elongation of the neck in rolling on single-line or reversible mills. The artificial local elongation of the neck on the forward strip end facilitates the entry and the exit of the strip respectively into and out of the passes, the same as in rolling on single-line mills which has been described above. This increases the durability of delivery guides, and prevents the possibility of damage to them and wrapping of the strip around the rolls.

The above angle of bevel of the billet on the faces that are vertical during rolling and the above length of the bevelled portion of the billet are necessary to provide an artificial local elongation of the strip neck, symmetric with respect to the billet axis and free from ruptures on the forward strip end. This configuration of the local elongation of the neck can be obtained only on condition of a symmetrical slitting of the forward end of the billet in the slitting pass, this being achieved by bevelling the end of the billet on the faces that are vertical during rolling at an angle smaller or equal to the angle of nip on the swell of the slitting pass and a length of bevel equal to 0.6–0.8 times the length of the deformation zone. This provides a vertical flat on the strip end, the width of which is comparable to that of the base of the swell of the slitting pass.

Owing to the above length of the bevelled end, the entire width of the billet enters the deformation zone and is centered by the sides of the pass relative to the vertical axis thereof; this being a necessary precondition for a symmetrical slitting of the forward strip end by the swell of the slitting pass.

The width of the billet is usually somewhat smaller than the width of the slitting pass because of the spread of metal during rolling. This may lead to a shift in the vertical axis of the billet relative to that of the slitting pass. However, given a vertical flat on the forward strip end, the small misalignment of the vertical axes of the billet and of the slitting pass causes no substantial asymmetry of the local elongation of the strip on its forward end.

If the angle of bevel on the faces that are vertical during rolling is greater than the angle of nip on the swell of the slitting pass, the vertical flat on the end of the billet may not be produced, thus resulting in an acute-angled forward strip end. Then, even a small misalignment of the vertical axis of the billet (and, therefore, of the acute-angled forward vertical edge thereof) relative to the vertical axis of the pass will lead to an asymmetrical shape of the artificial local elongation of the strip end and to a subsequent rupture thereof during rolling in the beam passes, a ruptured end hampering the entry of the strip into a pass.

The increase of the length of bevel of the forward end of the strip in excess of 0.8 times the length of the deformation zone results in the entire width of the billet failing to enter the deformation zone prior to the slitting of the forward strip end by the swell of the slitting pass and is not centered relative to the vertical axis of the deformation zone by the sides of the pass. The effect of this is a substantially asymmetrical local elongation of the neck on the forward strip end. In subsequent rolling in beam passes, the elongated asymmetrical length of the strip ruptures and so fails to facilitate the entry and the exit of the strip respectively into and out of the passes.

In addition, an excessive length of bevel may prevent the formation of the vertical flat on the bevelled end of the strip, which leads to an assymmetrical shape of the local neck elongation on the forward strip end and so renders difficult the entry of the strip into the passes.

The bevelling of the forward strip end over a length smaller than 0.6 times the length of the deformation zone provides no improvement in the entry and exit of a strip into and out of a pass. This results from the artificially formed local elongation of the neck on the forward strip end being insufficiently long for a leading entry of the strip neck into the rolls and subsequent smooth drawing of the strip flanges into the passes.

BRIEF DESCRIPTION OF THE DRAWINGS

These and other objects and features of the invention become readily apparent from one embodiment thereof which will now be described by way of example with reference to the accompanying drawings, in which:

FIG. 1 is a side elevation view of the forward end of a strip, bevelled on the faces that are horizontal during rolling, and rolls of a rolling mill;

FIG. 2 is an enlarged side elevation view of the forward end of a strip, bevelled, on the faces that are horizontal during rolling and on the faces that are vertical during rolling, as a strip enters a closed slitting pass;

FIG. 3 is a top plan view of the forward end of a strip, bevelled, on the faces that are horizontal during rolling and on the faces that are vertical during rolling, and a bottom roll; and FIG. 4 is a front elevation view of a billet entering a closed slitting pass.

DETAILED DESCRIPTION OF THE INVENTION

A method for rolling H-sections in a continuous mill, according to the invention, is put into effect in the manner herein described.

The forward end of a rectangular (or a square) billet or strip 1 (FIG. 1) is, prior to rolling in rolls 2 and 3 of a continuous medium-section mill, bevelled on the faces that are to be horizontal during rolling. The faces are bevelled at an angle $\beta$, equal to 30°, relative to the horizontal axis of the billet 1.

The bevelled billet 1 is heated to a temperature of rolling of about 1150°–1200° C. and rolled in the rolls 2 and 3 provided with a closed slitting pass. As the forward end of the billet 1 is bevelled at an angle $\beta$ equal to 30°, the billet 1 enters smoothly the first slitting pass, where it is transformed into an H-shaped strip.

The strip is then rolled in subsequent mill stands having rolls with closed beam passes.

As a result of bevelling, the strip enters the closed beam passes on the pass neck, as in single-line mills with local neck elongation at the strip end. The bevelled part of the strip is gripped by the rolls 2 and 3, and the strip is thus drawn positively into the pass although the width of the strip on the open flanges is greater than the width of the pass on the closed flanges.

The smooth entry of the strip flanges into subsequent passes is also facilitated by a gradual increase in the height of flanges on the bevelled end of the strip. This makes it possible to avoid impacts of the strip flanges against the external faces of the pass and substantially facilitates the entry of the strip into the closed beam passes.

The bevelled part of the strip is discharged from each pass onto a delivery guide, aligned with the neck of each pass, in advance of the flanges and, resting on this guide, aids in pulling the strip out of the closed flanges of each pass. Therefore bevelling of the strip end facilitates the exit of the strip out of each pass, avoids impacts of the strip flanges against the delivery guides, enhances the durability and prevents the failure thereof and, in consequence, the wrapping of the strip around the rolls.

The rolling of a billet in a continuous mill results in an H-shaped strip.

In the present example, the forward end of a rectangular billet 1 is bevelled prior to rolling on the faces that are to be horizontal during rolling at an angle $\beta$ of 30° relative to the horizontal axis of the billet 1.

However, the angle $\beta$ may range between 20° and 30°.

Should the angle $\beta$ increase in excess of 30°, the forward end of the billet 1 will tend to level off because of the build-up of metal during rolling in a slitting pass and of the shrinkage of the forward end of the strip along the neck during rolling in beam passes.

If the angle $\beta$ is smaller than 20°, the bevelled forward end of the billet 1 tends to be excessively long and, as the bevelled end of the strip is cropped after rolling, this results in an increased waste of metal.

In the present example, the forward end of the rectangular billet 1 is bevelled on the faces that are to be horizontal during rolling.

However, the present invention can be alternatively embodied in the manner below.

A billet 1 (FIG. 2) intended for the manufacture of H-sections in a continuous mill is, prior to rolling, bevelled on the faces that are to be horizontal during rolling at an angle $\beta$ equal to 26° and on the faces that are to be vertical during rolling at an angle $\gamma$ equal to 26°, which is equal to the angle of nip on a swell 5 of a slitting pass. The length of the bevel L is made equal to 0.7 times that of the deformation zone $\epsilon$, thus resulting in a vertical flat 4 of a width equal to half that of the base of the swell 5 of the slitting pass.

The bevelled billet 1 is first rolled in a closed slitting pass, then in closed beam passes.

At the start of the slitting of the forward end of the billet 1 (FIG. 3) by the swell 5 of the slitting pass, the billet 1 enters the deformation zone over the whole of its length B and is centered by sides 6 (FIG. 4) of the pass relative to the vertical axis thereof.

Despite a gap S (FIG. 3) between vertical faces 7 of the billet 1 and the sides of the pass, the forward end of the billet 1 is slitted symmetrically, as the possible misalignment of the axis of the billet 1 and of the vertical axis of the pass is within the width of the vertical flat 4 on the forward end of the billet 1.

In subsequent rolling in beam passes, the bevelled forward end of the strip is shaped into a local neck elongation which facilitates the entry and the exit of the strip respectively into and out of the passes. In addition, this also prevents damage to the delivery guides and the wrapping of the strip around the bottom roll 3 of the stand.

In this example, the faces that are to be vertical during rolling are bevelled at an angle $\gamma$ of 26°, which is equal to that of nip $\alpha$ on the swell 5 of the slitting pass.

However, the angle $\gamma$ may be smaller than the angle of nip $\alpha$ on the swell 5 of the slitting pass.

Should the angle of bevel $\gamma$ of the billet 1 exceed the angle of nip $\alpha$ on the swell 5 of the slitting pass, no vertical flat 4 is formed on the end of the billet, so that the forward end of the billet 1 is acute-angled in plan. In this case, even a small misalignment of the vertical axis of the billet 1 (and, therefore, of its forward acute-angled vertical edge) relative to the vertical axis of the pass results in an asymmetrical configuration of the artificial local elongation of the forward end of the strip and in subsequent rupture thereof during rolling in beam passes, thus rendering the entry of the strip difficult in each subsequent pass.

In the given example, the forward end of the billet 1 is bevelled over a length L equal to 0.7 time the length of the deformation zone l.

However, the bevelling may extend over a length L equal to 0.6–0.8 time the length of the deformation zone l.

An increase of the length of the bevel L of the forward end of the billet 1 in excess of 0.8 times the length of the deformation zone l results, as the slitting of the billet 1 begins, in the entire width of the forward end failing to initially enter the deformation zone and, in consequence, it is not centered relative to the vertical axis of the sides 6 of the pass. This causes asymmetry in the artificially formed local elongation of the neck on the forward strip end and ruptures thereof in subsequent rolling in the beam passes.

Moreover, no vertical flat 4 is formed on the bevelled end of the billet 1 with excessive length of the bevel L, thus also leading to an asymmetric shape of the local elongation of the neck on the forward end of the strip and rendering difficult the entry of the strip into the passes.

Should the forward end of the billet 1 be bevelled over a length L less than 0.6 times the length of the deformation zone l, the artificially formed local neck elongation on the forward end of the strip proves to be insufficiently long for a leading entry of the strip neck into the pass and a subsequent smooth drawing-in of the strip flanges into the pass.

What is claimed is:

1. A method for rolling H-sections in a continuous mill, comprising bevelling a forward end of a billet prior to rolling on the faces that are to be horizontal during rolling at an angle of 20°–30° relative to a horizontal axis of said billet, and subsequent rolling of said billet in slitting and beam passes.

2. A method as claimed in claim 1, wherein said forward end of said billet is bevelled on faces that are to be vertical during rolling at an angle smaller or equal to the angle of nip on a swell of the slitting pass.

3. A method as claimed in either claim 1 or 2, wherein said bevelling on said faces extends over a length equal to 0.6–0.8 times the length of the deformation zone.

* * * * *